United States Patent [19]

Schöner

[11] 4,337,703

[45] Jul. 6, 1982

[54] PROCESS AND ARRANGEMENT FOR GUIDING THE EFFECT OF UNDERWATER DETONATIONS OF UNDERWATER EXPLOSIVE BODIES

[75] Inventor: Hartmut Schöner, Bonn, Fed. Rep. of Germany

[73] Assignee: Diehl GmbH & Company, Fed. Rep. of Germany

[21] Appl. No.: 543,247

[22] Filed: Jan. 22, 1975

[30] Foreign Application Priority Data

Jan. 26, 1974 [DE] Fed. Rep. of Germany ..... 2403791

[51] Int. Cl.[3] ..... F42B 22/00; F42B 3/00; F42D 3/00

[52] U.S. Cl. ..... 102/406; 102/306

[58] Field of Search ..... 102/10, 21, 22, 23, 102/54, 20, 306, 406; 181/116–118, 115

[56] References Cited

U.S. PATENT DOCUMENTS

| | | | |
|---|---|---|---|
| 2,586,706 | 2/1952 | Parr, Jr. | 102/21 |
| 2,671,400 | 3/1954 | Duesing | 102/20 |
| 3,078,798 | 2/1963 | Poncelet | 102/23 |
| 3,109,373 | 11/1963 | Saffer, Jr. | 102/54 |
| 3,348,482 | 10/1967 | Keener et al. | 102/23 |

*Primary Examiner*—Charles T. Jordan
*Attorney, Agent, or Firm*—Neil F. Markva

[57] ABSTRACT

A method and apparatus are disclosed for guiding and increasing the effect of underwater detonation of an underwater explosive body, characterized in that a hollow space is defined adjacent the explosive body on the side thereof facing the target, whereby upon detonation of the explosive body, gases of high density are generated in the hollow space which are accelerated to high speed prior to meeting with the surrounding water.

4 Claims, 4 Drawing Figures

PROCESS AND ARRANGEMENT FOR GUIDING THE EFFECT OF UNDERWATER DETONATIONS OF UNDERWATER EXPLOSIVE BODIES

The invention relates to a process and arrangement for guiding and increasing the effect of underwater detonations of underwater explosive bodies.

The effect of the detonating explosive body of underwater explosive weapons is, as known, better than the effect of the same charge in the air. This is due to the specific higher density of water against air, on the one hand, and to the non-compressibility of water, on the other hand. It has been known to use explosive charges under water to cause destructions or deformations of objects present in water. Said explosive bodies are generally spherical or cylindrical without a particular jacket guiding the detonation. As a result thereof, the pressure wave caused by the detonation expands more or less uniformly in the space about the explosive body so that a relatively small portion of the pressure wave becomes effective for the destruction or deformation at the target being in one place only.

The hollow charge principle of an explosive body used in the air cannot be transferred to an underwater explosive weapon, because the hollow charge detonation jet would directly act on the water and substantially be used up before it arrives at the target. Even if, with the provision of an air space before the hollow charge, the jet would be allowed to first pass through air, the utilization of energy of the hollow charge would be reduced and the effect would be concentrated on a small region only.

It is the object of the invention to considerably increase the effect of the explosive charge of underwater explosive bodies by concentrating it in a predetermined direction. The invention is characterized with respect to underwater detonations of underwater explosive bodies in that there is formed a hollow space enclosed against water in the direction of the target and joined to the underwater explosive body, in which hollow space the gases of high density generated by the detonation are accelerated to high speeds prior to meeting with the surrounding water.

Due to such a measure the energy of the detonated explosive substance is forced into a predetermined direction, the major part of the energy generated by the detonation of the explosive body will turn to the hollow space and is caused to follow a predetermined direction. This is due to the fact that the gases of high density produced by the detonation take the way of the least resistance. It is determined by the given hollow space while, where the hollow space does not follow the underwater explosive body, the expansion of the clouds is barred considerably stronger than in the direction in which the hollow space is provided at the underwater explosive body. The penetration is much inferior against water than against the created hollow space. The gases of high density being capable of developing high speeds in said hollow space, a considerable impulse is produced by which the gases of high density act at the end of the hollow space on the water surrounding the hollow space. The penetration obtained is not only high but also controlled.

The hollow space can be obtained in different ways. On the one hand, it is possible to form it by an air pocket shortly before the detonation of the explosive body, at the target side. On the other hand, the hollow space can be formed by a hollow body which, at the target side, has an end wall of small thickness. In both the cases, it is essential that the hollow space closely joins the explosive body so that the gases, on account of the detonation of the explosive charge, may accelerate without coming into contact with water to then hit upon the water wall concerned with a higher impulse.

For the formation of a cavity generated by a bubble or pocket, use can be made of a small bursting charge or the like provided at the target side of the explosive body and held conveniently in place by a mounting assembly. The priming of the explosive charge by means of a fuse cord can be so devised that it is realized before the priming of the explosive charge itself.

There may be provided also as a hollow space a hollow body extending longitudinally in the direction of the target and formed by walls of solid material. At the end wall directed to the target side the hollow body is fitted with a flexible diaphragm or the like so that the hollow body is completely enclosed against the surrounding water.

The hollow body may have different shapes. It can be cylindrical, it can be designed as a nozzle converging or diverging in the direction to the target. The hollow body is conveniently firmly connected with the explosive charge and the connection mentioned is watertight.

The drawing shows several working examples for the configuration of underwater explosive bodies according to the invention.

Figure 1:
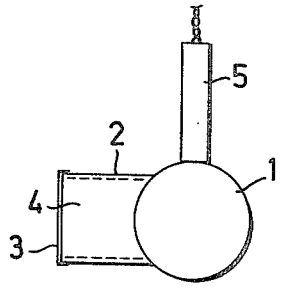
FIGS. 1 to 3 show an elevation and schematic view of an underwater explosive body according to the invention with a hollow space formed by a hollow body in the direction of the target to be hit.

The underwater explosive body 1 is provided with a hollow body 2 at a predetermined side facing the (non-illustrated) target, which body is connected with the explosive body 1 in a water-tight manner. The hollow body 2 is cylindrical and in the direction to the target, it is watertightly closed by a wall 3. The end wall can be a diaphragm. The cylindrical hollow body 2 forms a hollow space 4 in which the pressure wave formed by the detonation of the explosive can easily expand without hitting upon the water surrounding otherwise the explosive body 1. The hollow space 4 should advantageously have such an extension or length that the gases of high density formed by the detonation of the explosive body, may be accelerated to high speeds prior to hitting the end wall 3 and the resisting water. The explosive body 1 is fitted with a fuse 5 arranged conveniently in cross direction relative to the hollow body 2 or the hollow space 4 respectively.

Figure 2:
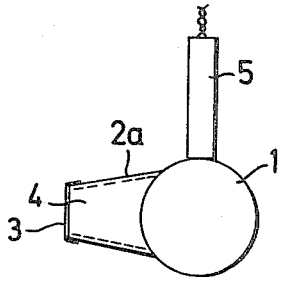
Figure 3:
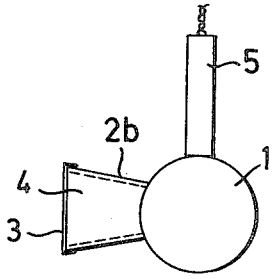

In the embodiment according to FIG. 2, the hollow body 2*a* is desiged to converge outwardly in the direction to the target so that the hollow body is shaped like a nozzle. In case of FIG. 3, the hollow body 2*b* is formed to be divergent in the direction to the target.

With such underwater explosive bodies, the detonation effect of the ignited explosive charge first develops in air by the hollow body fitted to the explosive body, namely substantially focussed to the hollow space created by the hollow body. Upon a penetration of the solid wall part of the hollow body the accelerated gases of high density flow through the water to the target dictated by the direction caused by the hollow body. With an arrangement of one plate each in a predetermined distance from the explosive body before the hollow body and, on the opposite side, at the same distance from the hollow body, it can be found that the plate provided at the side of the hollow body is perforated to a considerable extent with the underwater test, and a hole is formed in the plate, while the rear plate does not suffer from any damages or impressions or the like.

Figure 4:
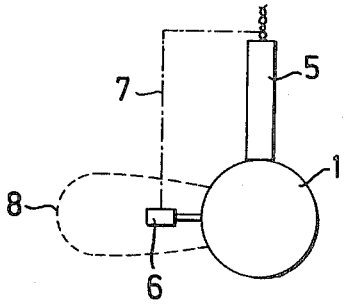
FIG. 4 illustrates a schematic view of a further embodiment concerning the formation of the directive hollow space at the underwater explosive.

In case of the embodiment of FIG. 4, there is provided at the side of the explosive body 1 facing the target, a bursting charge 6 serving during the detonation to form a gas bubble, being longitudinal, if advantageous. The bursting charge 6 is connected with the detonator 5 via a fuse cord 7 or a fuse chain, so that with the ignition of the explosive body 1, there is ignited first bursting charge 6 before the detonation of the explosive body 1 takes place. By this means, a gas bubble 8 can be built up in the water surrounding the explosive body 1 into which bubble the pressure wave of the detonation gases of explosive body 1 will expand. A gas bubble generated this way has the same effect as the hollow body of the embodiment of FIGS. 1 to 3. The bursting charge 6 is advantageously of longitudinal shape to cause a gas bubble of longitudinal shape which extends in direction to the target to be hit.

What is claimed is:

1. Apparatus for guiding and increasing the effect of underwater detonation of an underwater explosive body, comprising (a) an underwater explosive body (1) adapted to be submerged in a body of water adjacent a target;

(b) means (2) including a separate rigid generally cylindrical hollow wall regidly secured at one end to said explosive body for defining a hollow space on the side of said explosive body facing the target; and (c) means (5) for detonating said explosive body to cause the gases of high density generated in the hollow space by the detonation of the explosive charge to be accelerated to high speeds prior to meeting with the surrounding water.

2. Apparatus as defined in claim 1, and further including flexible diaphragm means (3) closing the end of said cylindrical wall remote from said explosive body.

3. Apparatus as defined in claim 2, wherein said rigid wall has the configuration of a right cylinder.

4. Apparatus as defined in claim 2, wherein said hollow wall has a nozzle-shaped truncated conical configuration converging toward one end thereof.

* * * * *